United States Patent [19]

McReynolds et al.

[11] 4,308,972

[45] Jan. 5, 1982

[54] SEPARABLE HINGE ASSEMBLY FOR A DOOR

[75] Inventors: Billy L. McReynolds; Richard L. Barnett, both of Altamont, Kans.

[73] Assignee: Power-Flame, Inc., Parsons, Kans.

[21] Appl. No.: 182,652

[22] Filed: Aug. 29, 1980

[51] Int. Cl.[3] ..... B65D 43/24

[52] U.S. Cl. ..... 220/335; 220/337; 16/266

[58] Field of Search ..... 220/3.8, 6, 334, 335, 220/337; 16/128 R, 172

[56] References Cited

U.S. PATENT DOCUMENTS

| | | | |
|---|---|---|---|
| 610,010 | 8/1898 | Winter | 16/172 |
| 974,953 | 11/1910 | Darlinton | 16/172 |
| 1,213,157 | 1/1917 | Conway | 220/335 |
| 2,570,992 | 10/1951 | Thomas | 16/128.1 |
| 2,767,032 | 10/1956 | Mitchell | 304/9 |
| 2,852,802 | 9/1958 | Seby | 16/135 |
| 2,969,889 | 1/1961 | Morterol | 220/6 |
| 3,348,259 | 10/1967 | Wilhelmsen et al. | 16/128 |
| 3,878,585 | 4/1975 | Morris | 16/128 |

*Primary Examiner*—George T. Hall

*Attorney, Agent, or Firm*—Roylance, Abrams, Berdo & Farley

[57] ABSTRACT

A hinge assembly which allows pivotal movement between first and second panels of 90° and which allows separation of the two panels. The hinge assembly comprises a first portion located on the first panel and having a lip extending substantially perpendicularly therefrom, a second portion located on the second panel, and a hinge member rigidly coupled to the second panel and having an arm defining a slot with the second portion, which slot receives the lip therein when the first and second panels are substantially perpendicular and receives the first portion therein when the first and second panels are substantially parallel.

21 Claims, 6 Drawing Figures

SEPARABLE HINGE ASSEMBLY FOR A DOOR

FIELD OF THE INVENTION

The present invention relates to a separable hinge assembly which allows pivotal movement through 90°. The assembly can advantageously be used for sheet metal doors coupled to sheet metal boxes, such as boxes containing electrical equipment. The hinge member comprises a single piece of bent sheet metal.

BACKGROUND OF THE INVENTION

Numerous hinge assemblies are known in the prior art for thin sheet metal panels, such as those used to pivotally couple a door to a box containing electrical equipment. There are, however, numerous disadvantages to many of these prior art hinge assemblies. For example, many of them are not separable so that the door cannot readily be detached from the box. In addition, many of these prior art devices do not limit the pivotal movement of the door relative to the box so that such relative pivotal movement varies widely in an uncontrolled manner.

Moreover, many of these prior art hinge assemblies are very expensive to form, such as for example piano hinges. In addition, such hinges require considerable time to attach to the door and the box, especially since various parts must be carefully aligned along the pivotal axis. Finally, many of the prior art hinge assemblies have intricate curved or tubular portions which require complicated manufacture and exacting tolerances.

Examples of these prior art devices are disclosed in U.S. Pat. Nos. 610,010, issued on Aug. 30, 1898 to Winter; 974,953, issued on Nov. 8, 1910 to Darlinton; 2,570,992, issued on Oct. 9, 1951 to Thomas; 2,767,032, issued on Oct. 16, 1956 to Mitchell; 2,852,802, issued on Sept. 23, 1958 to Seby; 2,969,889, issued on Jan. 31, 1961 to Morterol; 3,348,259, issued on Oct. 24, 1967 to Wilhelmsen et al; and 3,878,585, issued on Apr. 22, 1975 to Morris.

SUMMARY OF THE INVENTION

Accordingly, a primary object of the present invention is to provide a separable hinge assembly with limited pivotal movement that is inexpensive to manufacture.

Another object of the present invention is to provide such a hinge assembly which does not require complicated manufacturing steps or exacting tolerances.

Another object of the present invention is to provide a hinge assembly which is easily aligned during formation of the hinged combination.

The foregoing objects are basically attained by providing a hinge assembly for first and second panels, the combination comprising a first portion located on the first panel; a lip extending substantially perpendicularly from the first portion; a second portion located on the second panel; a hinge member; means for rigidly coupling the hinge member to the second panel, the hinge member comprising an arm, and an intermediate portion extending from the second panel and having the arm extending therefrom towards and substantially perpendicular to the second portion, the arm having a distal edge forming a slot with the second portion, which slot receives a portion of the lip therein when the first and second portions are substantially perpendicular, and receives a portion of the first portion therein when the first and second portions are substantially parallel.

Advantageously, the hinge member is a piece of sheet metal bent in two places to form a base portion, an intermediate portion extending from the base portion and the arm extending from the intermediate portion. The base portion can be spot welded to the second panel and the slot can be made slightly larger than the thickness of the lip for easy separation and construction of the hinge assembly.

In the position in which the first and second portions are perpendicular, the outer surface of the arm forms a stop against the inner surface of the first portion on the first panel. In the position in which the first and second portions are substantially parallel, the inner surface of the arm acts as a stop against the inner surface of the lip.

Other objects, advantages and salient features of the present invention will become apparent from the following detailed description which, taken in conjunction with the annexed drawings, discloses a preferred embodiment of the present invention.

DRAWINGS

Referring now to the drawings which form a part of this original disclosure:

DETAILED DESCRIPTION OF THE INVENTION

Figure 1:
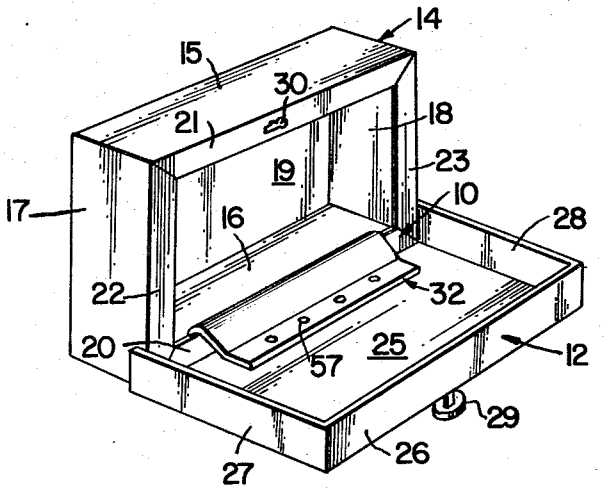
FIG. 1 is a perspective view of a sheet metal box having a door pivotally coupled thereto with a hinge assembly in accordance with the present invention.

As seen in FIG. 1, the hinge assembly 10 in accordance with the present invention hingedly couples a door 12 to a box 14. Both the door and the box are advantageously formed from sheet metal, the box 14 comprising a top panel 15, a bottom panel 16, a left side panel 17, a right side panel 18, a rear panel 19 and a front face formed from a plurality of flanges or lips bent from the top, bottom, left side and right side panels including a bottom lip 20, a top lip 21, a left side lip 22 and a right side lip 23.

The door 12 has a central panel 25 with a top flange 26, a left side flange 27 and a right side flange 28 extending perpendicularly therefrom.

As seen in FIG. 1, the hinge assembly 10 hingedly couples the door 12 to the box 14 for pivotal movement from the opened position shown in FIG. 1 where the central panel 25 of the door is substantially parallel to the bottom panel 16 of the box to a position in which these panels are perpendicular. In order to lock the door 12 in the closed position a knob 29 is conventionally located in the central panel 25 with a key, not shown, at the end thereof which is receivable in a corresponding keyhole 30 in the top lip 21 of box 14. Relative sideways motion of the door and the box is prevented in both the opened and closed position by means of the side flanges 27 and 28 abutting the exterior surfaces of the left side panel 17 and the right side panel 18 of the box 14.

Figure 2:
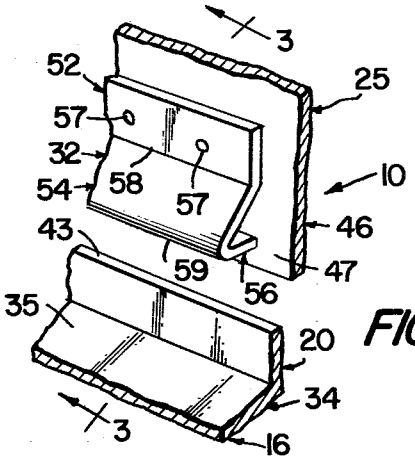
FIG. 2 is an enlarged, fragmentary perspective view of the hinge assembly in accordance with the present invention.

Referring now to FIG. 2, the hinge assembly 10 in accordance with the present invention is shown in the separated position in which the hinge member 32 is rigidly coupled to the central panel 25 and is in a position to be connected with the bottom lip 20 which extends from the bottom panel 16.

Figure 3:
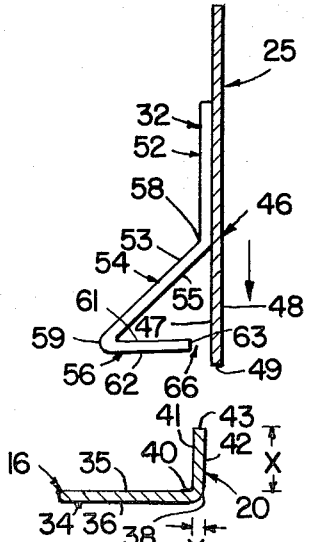
FIG. 3 is a side elevational view in section taken along lines 3—3 in FIG. 2 showing the hinge assembly in its separated form.
Figure 4:
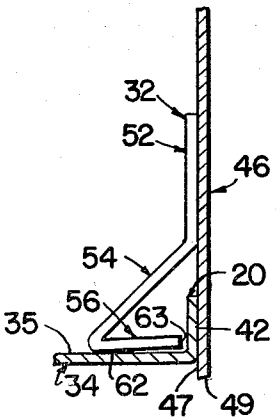
FIG. 4 is a sectional view similar to that shown in FIG. 3 except that the hinge assembly has been connected, with the first portion on the first panel being perpendicular to the second portion of the second panel.
Figure 5:
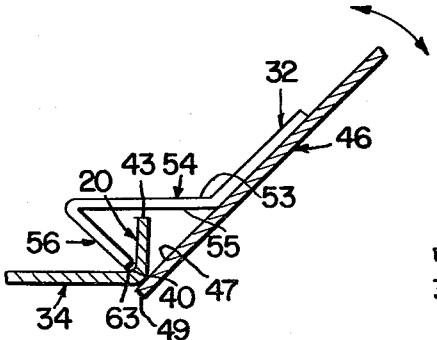
FIG. 5 is a sectional view similar to that shown in FIG. 4 except that the first and second panels have been pivotally moved through about 45° about the pivot axis provided by the hinge assembly.
Figure 6:
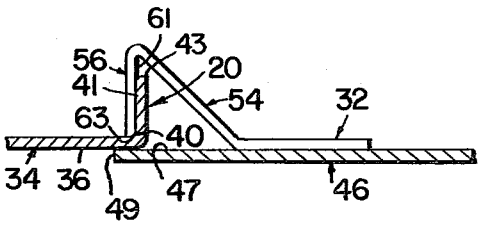
FIG. 6 is a sectional view similar to that shown in FIG. 5 except that the first and second panels have been pivoted about the hinge assembly to a substantially parallel position.

As is evident from FIGS. 4–6, the hinge assembly 10 pivotally couples the bottom panel 16 and the central panel 25. In particular, referring to the bottom panel 16 as a first panel and the central panel 25 as a second panel, the first panel 16 has a first portion 34 at the end thereof which as seen best in FIG. 3 has a planar inner surface 35 and a planar outer surface 36 which are parallel. Extending perpendicularly to the first portion 34 is the lip 20 which is integrally formed with first portion 34 and bent therefrom along bend line 38. The lip 20 forms an interior corner 40 with the first portion 34, the lip having a planar inner surface 41 and a planar outer surface 42 which are parallel. As seen in FIG. 3, the corner 40 is defined by the inner surface 41 of the lip 20 and the inner surface 35 of the first portion 34.

As seen in FIG. 3, lip 20 has a thickness designated y and a height designated x. At the end of lip 20 is a planar straight distal edge 43.

Advantageously, the first portion 34 and lip 20 are formed from 16 gauge cold roll steel in sheet metal form with a thickness of 0.0625 inches.

Referring again to FIG. 2, the central or second panel 25 has at its end a second portion 46 which as also seen in FIG. 3 has a planar inner surface 47, a planar outer surface 48 and a straight planar distal edge 49 at the bottom thereof. The second panel 25 including the second portion 46 is advantageously formed from 16 gauge cold roll steel in sheet metal form with a thickness of 0.0625 inches.

The hinge member 32 as seen in FIGS. 2 and 3 comprises an integral piece of bent sheet metal also advantageously of 16 gauge cold roll steel having a thickness of 0.0625 inches. Hinge member 32 comprises a base portion 52, an intermediate portion 54, and an arm 56. The base portion 52 is advantageously spot welded to the second panel 25 so that the arm 56 is adjacent the second portion 46, the spot welds being designated by reference numerals 57 in FIGS. 1 and 2. The intermediate portion 54 extends integrally from the base portion 52 at bend line 58 at an angle of advantageously about 46.5° to the inner planar surface 47 of the second portion 46. This angle of 46.5° is advantageous in the configuration of the hinge assembly 10 shown in FIG. 3 although the specific angle or for that matter the configuration of the intermediate portion 54 can be anything desired as long as the intermediate portion 54 does not interfere with, that is, bind against, the lip 20 and prevent the pivotal movement of the first portion 34 and the second portion 46 as seen in FIG. 5 and to be described in more detail hereinafter. The intermediate portion has a planar outer surface 53 and a planar inner surface 55, which are parallel.

As seen in FIGS. 2 and 3, the arm 56 extends from the intermediate portion 54 integrally at bend line 59 and extends substantially perpendicularly towards the first portion 46. This extension need not be exactly perpendicular but it is preferable to be plus or minus 5° away from the perpendicular orientation. Advantageously, the angle between the arm 56 and the intermediate portion 54 is about 40°. The length of the arm 56 is greater than the height x of lip 20 so the arm 56 and the intermediate portion 54 do not interfere with the lip during the pivotal movement shown in FIG. 5 and in the open position of the hinge assembly 10 shown in FIG. 6.

The arm 56 has a planar inner surface 61 and a planar outer surface 62 which are parallel, the end of the arm 56 having a planar straight distal edge 63.

A slot 66 is defined between the distal edge 63 of arm 56 and the inner surface 47 of the second portion 46. The thickness of this slot 66 is advantageously at least equal to and preferably slightly greater than the thickness x of the lip 20 so that the lip 20 can easily be received in the slot as seen in FIG. 4. Based on the thickness of the steel sheet material referred to above in forming the first and second panels, the slot 66 can be 1.5 times the thickness of lip 20. This will provide some "play" therebetween; however, this does not unduly reduce the efficiency of the hinge assembly 10 and accordingly allows the lip 20 to slip into the slot 66 very easily.

Connecting The Hinge Assembly

As seen in FIG. 3, the second portion 46 having the hinge member 32 rigidly coupled thereto is in a position separated from the first portion 34. In order to connect these two portions, the second portion 46 is moved downwardly so that the lip 20 is received in slot 66, such relative movement being continued until the outer surface 62 of arm 56 abuts the inner surface 35 of the first portion 34, as seen in FIG. 4.

In this position, the first portion 34 and the second portion 46 are substantially perpendicular. In addition, the lower distal edge 49 of the second portion 46 lies in a plane that is spaced below the arm and below the plane containing the inner surface 35 of first position 34. As seen in FIG. 4, the distal edge 63 of arm 56 is slightly spaced from the inner surface 41 of lip 20 which results from the play therebetween. However, the hinge assembly 10 in accordance with the present invention could work if there was contact therebetween as long as the lip 20 could easily fit into the slot 66. In addition, as seen in FIG. 4, the outer surface 62 of the arm 56 does not lie completely flush with the inner surface 35 of the first portion 34. This could however be a flush arrangement if desired. In all events, in the position shown in FIG. 4, the arm 56 forms a stop with the first portion 34 so that the first portion 34 and the second portion 46 are substantially perpendicular.

In this position, the slot 66 receives a portion of the lip therebetween. As also seen in FIG. 4, the outer surface 42 of the lip 20 is in a substantially abutting relationship with the inner surface 47 of the second portion 46 although this is not absolutely necessary since there is some play between the thickness of the slot 66 and the thickness of the lip 20.

Pivoting The Hinge Assembly

Referring now to FIG. 5, the second portion 46 is shown being pivoted relative to the first portion 34 with the contact of the distal end 63 of arm 56 in conjunction with corner 40 defined by lip 20 and the first portion 34 substantially defining the pivotal axis of such movement. In addition, during such movement the inner surface 47 of the second portion 46 tends to ride around the exterior portion of that corner 40. It is important to note that during such pivotal movement the distal edge 43 of lip 20 does not interfere with the intermediate portion 54 on hinge member 32, that is, contact therebetween does not prevent the pivotal movement. In this regard, there may be some contact and a slight bending of the hinge member 32 as long as the pivotal movement can take place.

With the pivotal movement continuing, the hinge assembly 10 is fully opened as seen in FIG. 6 with the first portion 34 being substantially parallel to the second portion 46. In this opened position shown in FIG. 6, the arm 56 acts as a stop to prevent additional pivotal movement with the inner surface 61 of the arm 56 abutting against the inner surface 41 of the lip 20 and with the distal edge 63 of the arm 56 being located in corner 40. In addition, the inner surface 47 of the second portion 46 abuts against the outer surface 36 of the first portion 34. The distal edge 43 of the lip 20 is spaced just below the intermediate portion 54, although there could be some contact therebetween as long as the abutting relationship of arm 56 and lip 20 in addition to the abutting relationship of the second portion 46 and the first portion 34 remains substantially intact.

While one advantageous embodiment has been chosen to illustrate the present invention, it will be understood by those skilled in the art that various changes and modifications can be made thereto without departing from the scope of the invention as defined in the claims appended hereto.

In a working embodiment of the subject invention the length of the arm 56 was advantageously one-half inch and the length of the intermediate portion 54 was seven-eighths inch.

Although as seen in FIG. 1 the door 12 is made so that it is substantially vertical when closed and horizontal when opened, the door and box can be oriented substantially in any direction relative to the pivot axis of the hinge assembly 10 as long as the door 12 will not fall from the box 14 which would occur were the apparatus shown in FIG. 1 placed upside down.

What is claimed is:

1. A hinge assembly for first and second panels, the combination comprising:

a first portion located on said first panel;

a lip extending substantially perpendicularly from said first portion;

a second portion located on said second panel;

a hinge member; and means for rigidly coupling said hinge member to said second panel, said hinge member comprising an arm, and an intermediate portion extending from said second panel and having said arm extending therefrom towards and substantially perpendicular to said second portion, said arm having a distal edge forming a slot with said second portion, which slot receives a portion of said lip therein when said first and second portions are substantially perpendicular, and receives a portion of said first portion therein when said first and second portions are substantially parallel.

2. A hinge assembly according to claim 1, wherein said arm has inner and outer substantially planar surfaces, said first portion has inner and outer substantially planar surfaces, said lip has inner and outer substantially planar surfaces, and said second portion has an inner substantially planar surface.

3. A hinge assembly according to claim 1, wherein said arm has an inner substantially planar surface.

4. A hinge assembly according to claim 1, wherein said arm has an outer substantially planar surface.

5. A hinge assembly according to claim 1, wherein said first portion has an inner substantially planar surface.

6. A hinge assembly according to claim 1, wherein said first portion has an outer substantially planar surface.

7. A hinge assembly according to claim 1, wherein said lip has an inner substantially planar surface.

8. A hinge assembly according to claim 1, wherein said lip has an outer substantially planar surface.

9. A hinge assembly according to claim 1, wherein said second portion has an inner substantially planar surface.

10. A hinge assembly according to claim 1, wherein said intermediate portion and said arm are integrally formed.

11. A hinge assembly according to claim 1, wherein said hinge member further comprises a base portion extending from said intermediate portion, and said means for rigidly coupling said hinge member to said second panel comprises a plurality of spot welds between said base portion and said second panel.

12. A hinge assembly according to claim 1, wherein said arm extends from said intermediate portion a distance at least as large as the distance said lip extends from said first portion.

13. A hinge assembly according to claim 1, wherein said intermediate portion extends from said second portion at an angle of about 46.5°.

14. A hinge assembly according to claim 1, wherein said arm extends from said intermediate portion at an angle of about 40°.

15. A hinge assembly according to claim 1, wherein said slot is at least as wide as the thickness of said lip.

16. A hinge assembly according to claim 1, wherein said second portion has a distal edge located below said arm.

17. A hinge assembly for first and second panels, the combination comprising:

a first portion located on said first panel;

a lip extending from said first portion;

a second portion located on said second panel;

a hinge member; and means for rigidly coupling said hinge member to said second panel, said hinge member comprising an arm, and an intermediate portion extending from said second panel and having said arm extending therefrom towards said second portion, said arm having a distal edge forming a slot with said second portion, which slot receives a portion of said lip therein when said first and second portions are substantially perpendicular, and receives a portion of said first portion therein when said first and second portions are substantially parallel, said lip being substantially planar and removably receivable in said slot so that said first and second portions are separable when they are substantially perpendicular.

18. A hinge assembly for first and second panels, the combination comprising:

a first portion located on said first panel;

a lip extending from said first portion;

a second portion located on said second panel;

a hinge member; and means for rigidly coupling said hinge member to said second panel, said hinge member comprising an arm, and an intermediate portion extending from said second panel and having said arm extending therefrom towards said second portion, said arm having a distal edge forming a slot with said second portion, which slot receives a portion of said lip therein when said first and second portions are substantially perpendicular, and receives a portion of said first portion therein when said first and second portions are substantially parallel, said lip extending substantially perpendicularly from said first portion.

19. A hinge assembly for first and second panels, the combination comprising:

a first portion located on said first panel;

a lip extending from said first portion;

a second portion located on said second panel;

a hinge member; and means for rigidly coupling said hinge member to said second panel, said hinge member comprising an arm, and an intermediate portion extending from said second panel and having said arm extending therefrom towards said second portion, said arm having a distal edge forming a slot with said second portion, which slot receives a portion of said lip therein when said first and second portions are substantially perpendicular, and receives a portion of said first portion therein when said first and second portions are substantially parallel, said arm being substantially perpendicular to said second portion.

20. A hinge assembly according to claim 17, wherein said arm is substantially planar.

21. A hinge assembly according to claim 17, wherein said second portion has a substantially planar inner surface facing the distal edge of said arm.

* * * * *